US010287804B2

(12) United States Patent
Chantler et al.

(10) Patent No.: US 10,287,804 B2
(45) Date of Patent: May 14, 2019

(54) APPARATUS FOR SECURING TWO MEMBERS TOGETHER

(71) Applicants: Roger Ian Chantler, Cradley Heath (GB); Ian Southall, Wolverley (GB)

(72) Inventors: Roger Ian Chantler, Cradley Heath (GB); Ian Southall, Wolverley (GB)

(73) Assignee: UAP LIMITED, Whitefield, Manchester (GB)

( * ) Notice: Subject to any disclaimer, the term of this patent is extended or adjusted under 35 U.S.C. 154(b) by 63 days.

(21) Appl. No.: 15/529,198

(22) PCT Filed: Nov. 18, 2015

(86) PCT No.: PCT/GB2015/000301

§ 371 (c)(1),
(2) Date: May 24, 2017

(87) PCT Pub. No.: WO2016/083765

PCT Pub. Date: Jun. 2, 2016

(65) Prior Publication Data

US 2017/0328088 A1 Nov. 16, 2017

(30) Foreign Application Priority Data

| | | |
|---|---|---|
| Nov. 28, 2014 | (GB) | 1421124.7 |
| Oct. 2, 2015 | (GB) | 1517431.1 |
| Oct. 16, 2015 | (GB) | 1518394.0 |

(51) Int. Cl.
*E05B 65/08* (2006.01)
*E05B 17/20* (2006.01)
(Continued)

(52) U.S. Cl.
CPC ..... *E05B 65/0858* (2013.01); *E05B 17/2088* (2013.01); *E05B 65/0835* (2013.01);
(Continued)

(58) Field of Classification Search
CPC ..... E05B 65/0858; E05B 65/0835; E05B 17/2088; E05C 7/00; E05C 9/1808; E05C 9/1875; E05F 7/005; E05Y 2900/132
(Continued)

(56) References Cited

U.S. PATENT DOCUMENTS 2,406,459 A * 8/1946 Gibson ..... E05C 9/04 292/39
2,473,285 A * 6/1949 Koeser ..... E05B 65/0835 292/DIG. 46
(Continued)

FOREIGN PATENT DOCUMENTS

AU 2008230042 A1 5/2009
DE 102008000565 A1 9/2008
(Continued)

OTHER PUBLICATIONS

International Search Report for corresponding International Application No. PCT/GB2015/000301.

*Primary Examiner* — Suzanne L Barrett
(74) *Attorney, Agent, or Firm* — Egbert, McDaniel & Swartz, PLLC

(57) ABSTRACT

An apparatus is provided for securing together two members which are slidable towards and away from each other to provide a respective open and closed (locked) mode, wherein a plurality of devices are adapted to secure the members in a closed mode, and a control unit is adapted to operate the devices. The devices are in the embodiments described spaced longitudinally apart along a vertical edge or stile of a closure member, which may be a patio door, window, or other closure, with the control unit being disposed intermediate the devices and being operatively linked thereto by a connecting device for actuating the devices. The control unit may be driven manually by a control handle, by a solenoid, by an electric or electro-mechanical motor device, or by spring-loaded interlocking devices. The
(Continued)

devices cooperate with keeper devices for securing the closure members together in the closed (locked) mode.

18 Claims, 10 Drawing Sheets

(51) Int. Cl.
*E05C 9/18* (2006.01)
*E05F 7/00* (2006.01)
*E05C 7/00* (2006.01)

(52) U.S. Cl.
CPC ..... *E05C 7/00* (2013.01); *E05C 9/1808* (2013.01); *E05C 9/1875* (2013.01); *E05F 7/005* (2013.01); *E05C 2007/007* (2013.01); *E05Y 2900/132* (2013.01)

(58) Field of Classification Search
USPC ..... 70/107–109, 91, 95, 98–100
See application file for complete search history.

(56) References Cited

U.S. PATENT DOCUMENTS 3,213,652 A * 10/1965 Morton ..... E05B 65/087 292/145
3,774,342 A * 11/1973 Thom ..... E05D 15/066 16/99
4,475,313 A * 10/1984 Governale ..... E05B 65/0811 292/101
4,767,139 A * 8/1988 Hansing ..... E05C 7/02 292/150
5,290,077 A * 3/1994 Fleming ..... E05B 65/087 292/341.11
5,373,716 A * 12/1994 MacNeil ..... E05C 9/026 292/165
5,421,627 A * 6/1995 Yane ..... E05B 1/0015 292/101
2008/0005972 A1 1/2008 Cloutier et al.
2008/0078216 A1* 4/2008 Fleming ..... E05B 15/004 70/113
2010/0031579 A1 2/2010 Choi
2010/0218568 A1 9/2010 Nakanishi et al.

FOREIGN PATENT DOCUMENTS

EP 1340867 A1 9/2003
GB 2150633 A 7/1985
GB 2308404 A 6/1997
WO 2013189749 A1 12/2013

* cited by examiner 81,26

APPARATUS FOR SECURING TWO MEMBERS TOGETHER

The invention relates to apparatus for securing two members together, and particularly to such apparatus for securing two relatively slidable members such as patio doors together.

As is known, patio doors are a popular means of gaining access from a dwelling to an outside area such as a patio or garden. Generally there are two doors, mounted in a set of respective runners in generally the same plane so that in a closed position or mode, facing edges or stiles of the two doors butt up against one another. At least one of the doors can be slid from a closed or locked position or mode in which a door opening is closed by both doors, to an open position or mode in which the one door is slid away from the other so that the door opening is open for passage therethrough. Generally too, both doors are slid towards and away from one another in the closed and open modes. Often there is a lock to lock the two doors together in the closed mode. Prior doors are unfortunately generally vulnerable to forced entry.

As is also generally known, such a patio door is located in a top, in use, substantially horizontal frame section of the door frame. There is an interaction between a locating groove along a top of the door and a mating upstand on the frame. This area between the groove and upstand is also vulnerable to attack, as the junction can be disengaged by the application of force to the top of the door, particularly at its trailing edge.

It is an object of the invention to seek to mitigate these disadvantages.

According to the invention, there is provided apparatus for securing together two members which are slidable towards and away from each other to provide a respective open and closed mode, comprising a plurality of devices adapted to secure the members in a closed mode and a control unit adapted to operate the devices.

There may be in a preferred embodiment two spaced apart securing devices operable by a single control unit.

According to a second aspect of the invention, there is provided a slidable closure member in combination with apparatus as defined in the immediately preceding paragraph.

It will be understood that the invention extends to a building construction incorporating a slidable closure member as defined in the immediately preceding paragraph.

Apparatus for providing security for a slidable closure member such as a patio door having lockable means and being adapted to slide in a frame to provide a respective open and closed, locked, mode, is hereinafter described, by way of example, in the accompanying drawings.

Figure 4:
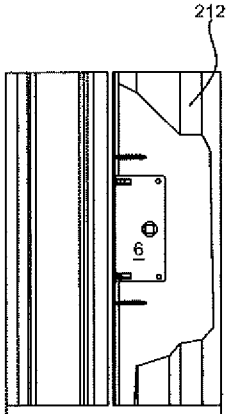
Figure 4A:
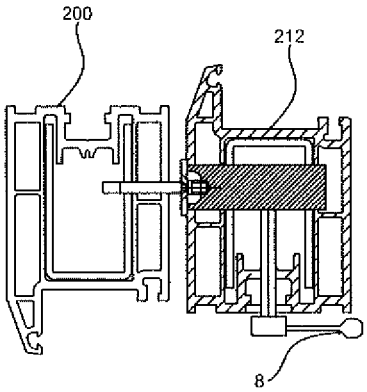
Figure 4B:
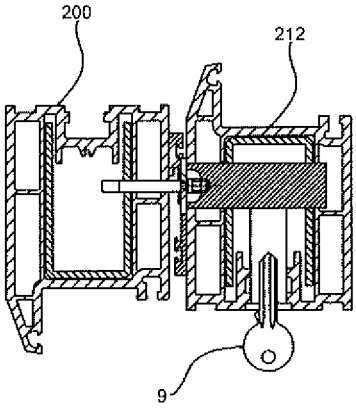
Figure 5:
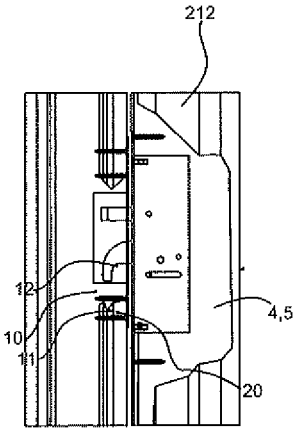
Figure 6A:
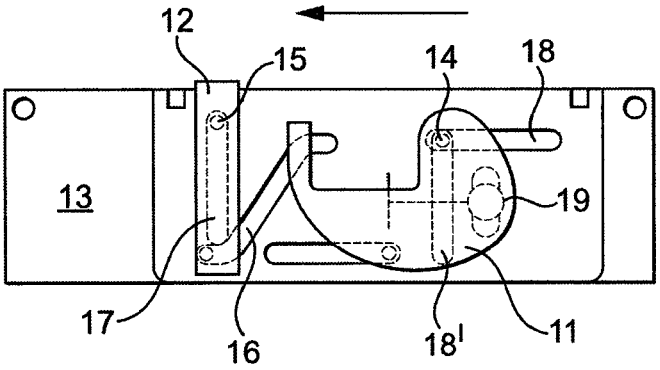
Figure 6B:
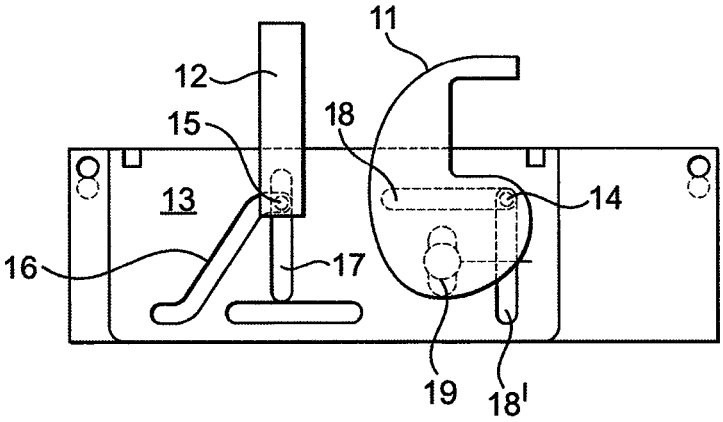
Figure 7A:
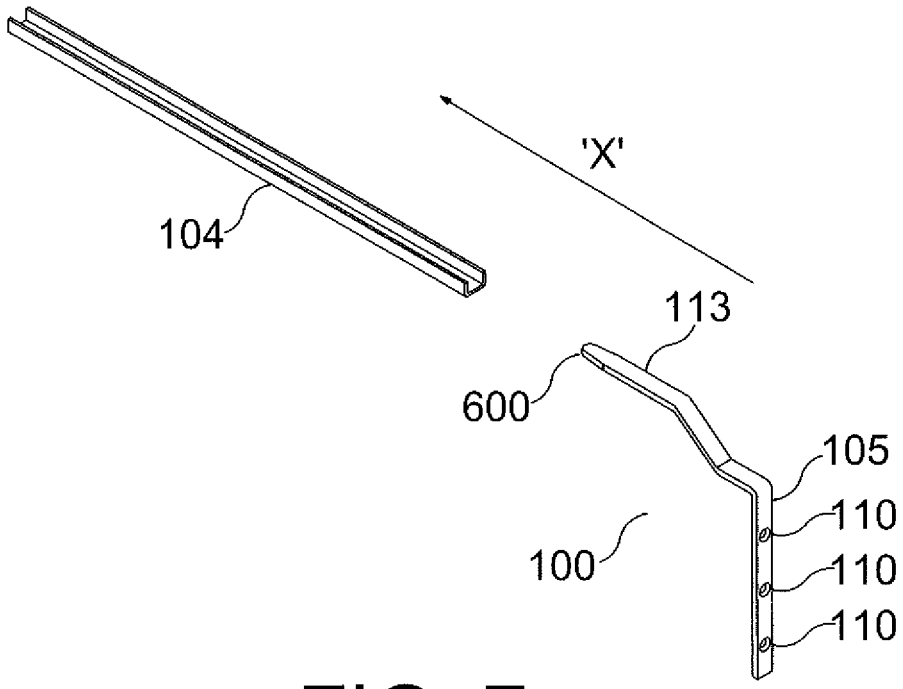
Figure 7B:
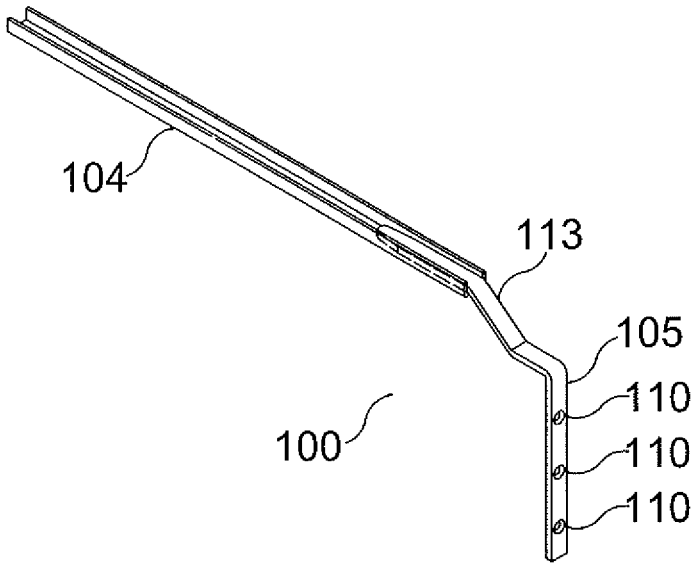
Figure 8A:
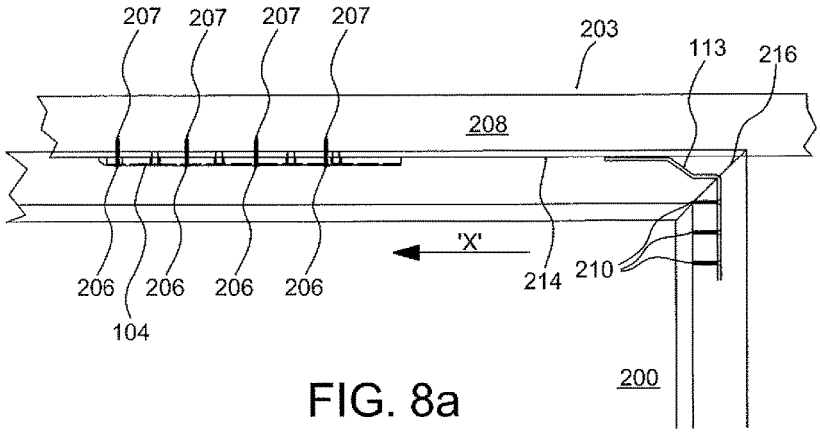
Figure 8B:
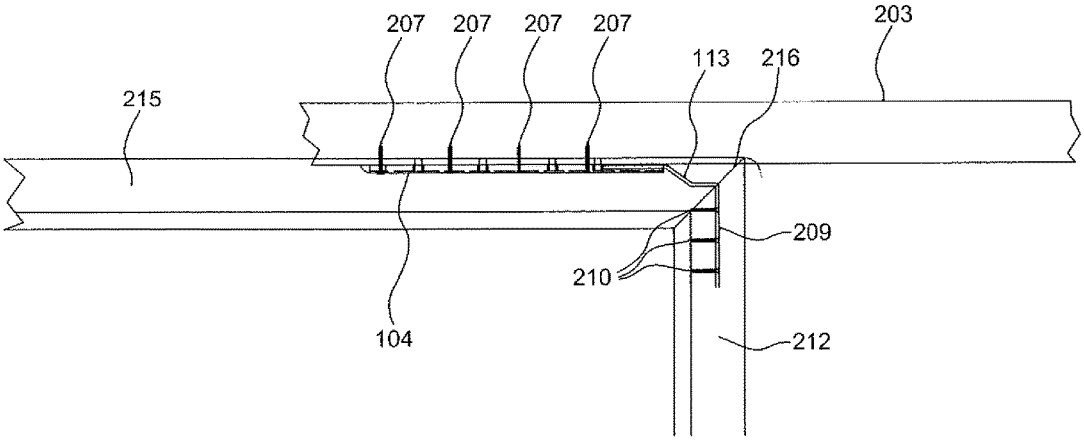
Figure 9:
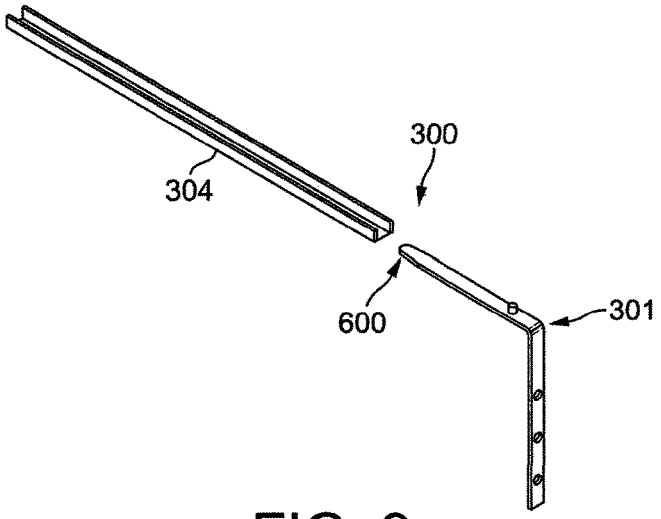
Figure 10A:
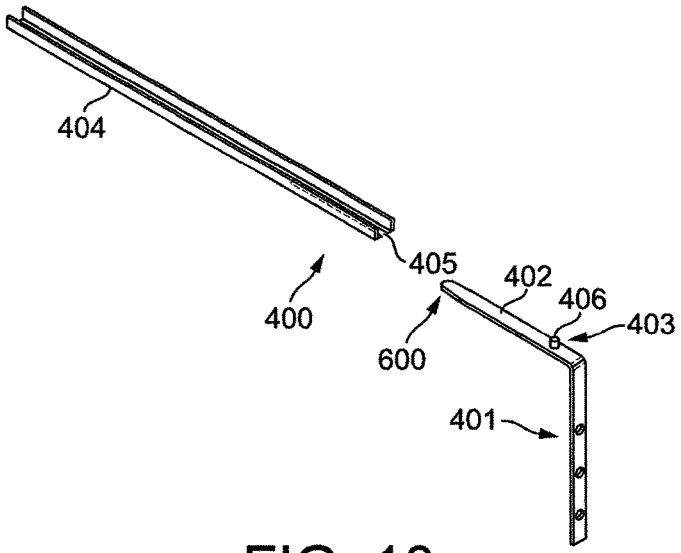
Figure 10B:
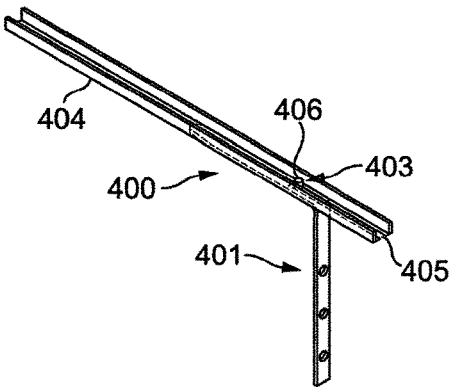
Figure 11A:
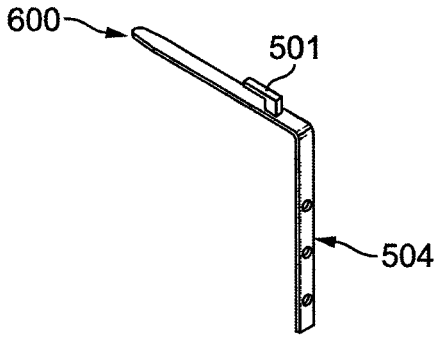
Figure 11B:
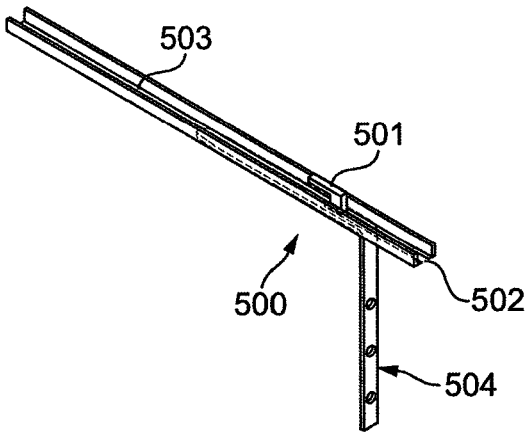
Figure 26:
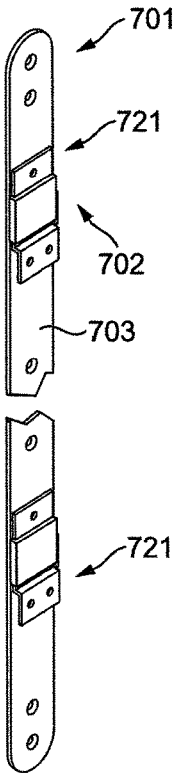
Figure 27:
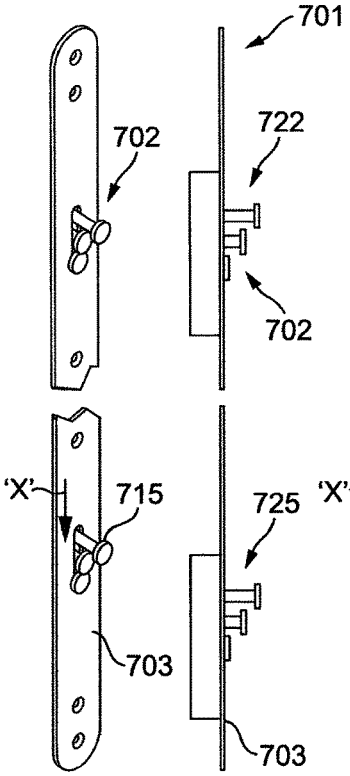
Figure 28:
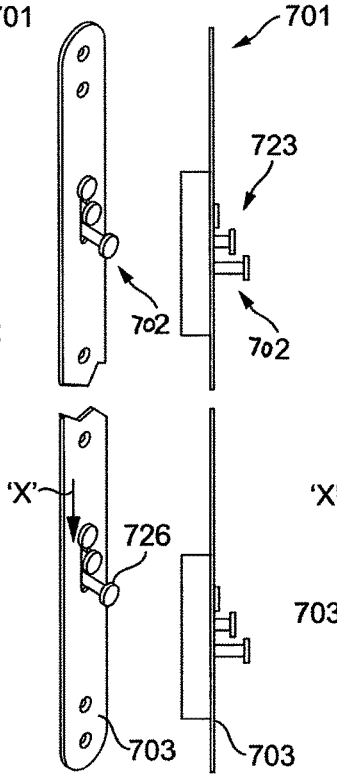
Figure 29:
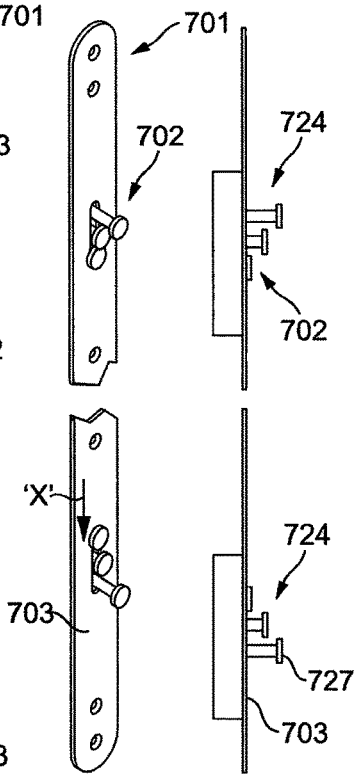

FIGS. 4, 4*a* and 4*b* show schematic views of a control unit, FIG. 4*a* showing it lever operated and FIG. 4*b* showing it key-operated;

FIG. 5 shows schematically an internal view of a securing device;

FIGS. 6*a* and 6*b* show schematic views of the internal mechanism of the securing device in the retracted and extended position of a hook-like member and an anti-lift device;

FIG. 7A shows a schematic perspective view of the apparatus in an open mode of the door;

FIG. 7B shows a schematic perspective view of the apparatus of FIG. 1A in a closed position of the door;

FIGS. 8A and 8B show schematic side elevational views respectively an arrangement of the apparatus of FIGS. 7A and 7B in relation to a door frame;

FIG. 9 is a schematic perspective view of a second embodiment of apparatus embodying the invention;

FIGS. 10A and 10B show respective views similar to those of FIGS. 7A and 7B, of a third embodiment of apparatus embodying the invention;

FIGS. 11A and 11B show respective views similar to those of FIGS. 7A and 7B, of a fourth embodiment of apparatus embodying the invention; and FIGS. 12-29 show schematic perspective views of respective individual embodiments of apparatus embodying the invention, FIGS. 27 -29 further showing to the same scale side elevational views of the respective apparatuses shown.

Figure 3:
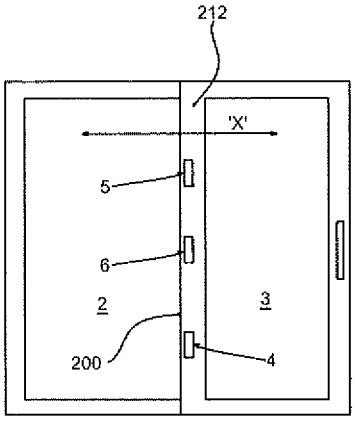
FIG. 3 is a schematic elevational view of an arrangement of two patio doors to a smaller scale than FIGS. 1 and 2, with the position of the apparatus according to the invention shown.

Referring firstly to FIGS. 1-6B of the drawings, there is shown apparatus 1 for securing together two members such as patio doors 2, 3 which are slidable towards and away from each other as shown by arrow 'X' in FIG. 3 to provide a respective open and closed mode, comprising a plurality of devices 4, 5 adapted to secure the members 2, 3 in a closed mode and a control unit 6 adapted to operate the devices 4,5.

In the embodiment shown, there are two spaced apart securing devices 4, 5 and a single control unit 6 situated intermediately of the two securing devices 4, 5. The control unit 6 is connected to an elongate member in the form of a flat connecting rod 7. A rotatable lever 8, FIG. 4*a*, or a key-operated barrel lock 9, FIG. 4*b*, are connected to the connecting rod 7 so that on rotation of the lever or key, the rod 7 is shifted longitudinally to operate both securing devices 4, 5 in unison.

The securing devices 4, 5 and control unit 6 are mounted with the connecting rod 7 on a face or stile of one of the patio doors. The facing stile of the other door mounts two keeper units 9, 10 positioned opposite the shifted position of the securing devices so that a hook-like member 11 and an anti-lift device 12 are extended out of the securing devices 4, 5 to engage with the keeper units 9, 10. To achieve this, there is a plate 13 connected to the connecting rod 7 via pins 14, 15 which engage a cover plate in blind slots 16,17,18, 18', the hook-like member 11 being pivoted at 19 , while the anti-lift device 12 is mounted in a guide for reciprocation orthogonally of the length of the connecting rod 7. The pins 14,15 and blind slots 16,17,18,18' act as cam and follower means so that on longitudinal movement of the slots to extend the hook-like devices 11 connecting rod 7, the pins ride along their respective slots to extend the hook-like devices 11 and anti-lift devices 12.

The keeper units 4, 5 and the hook-like members 11 have respective complementary sloping surfaces 20 so that any action to try to force the doors 2, 3 apart forces the complementary surfaces together, so hindering the action to try to force the doors apart.

In addition, the anti-lift device 12 is extended simultaneously to enter a facing slot in the keeper unit, so that any attempt to lift the doors 2, 3 apart is prevented.

Longitudinal movement of the connecting rod 7 in the opposite direction retracts the hook-like member 11 and anti-lift device 12 from the keeper unit 6 into the respective securing device, so that the doors 2, 3 can be slid apart.

As described above, there are two sets of hook-like devices 11 and anti-lift devices 12 both sets being driven simultaneously on operation of the intermediately disposed control unit 6.

The connecting rod is suitably covered by a cover strip 21.

Referring now to FIGS. 7A and 7B and 8A and B of the drawings, there is shown embodiments comprising apparatus 100 for providing security for a slidable closure member 200 such as a patio door (FIGS. 8A and 8B) and being adapted to slide in a frame 203 to provide a respective open and closed mode, comprising a keeper element 104 mountable on the frame 203 and a device 105 which is adapted to be releasably engageable with the keeper element 104 in the closed mode to maintain engagement of the slidable closure member 200 with the frame 203.

Suitably the apparatus 100 provides security for a slidable closure member having lockable means such as a patio interlock means ( not shown) of a patio door 200 and in the closed, locked, mode obviates disruption of the locking means.

The keeper element 104 is a channel section member, upwardly open in use and as shown, which has longitudinally spaced through holes 206 each of which in use receives securing means such as screws 207 which are screwed into the upper horizontal lintel or transom 208 of (the) fixed door frame 203 in relation to which the closure member 200 can slide horizontally between the open and closed, locked, mode.

The device 105 in the embodiment has one part 109 securable as by screws 210 passed through through holes 110 in the part 212 of the door section above the lockable means (not shown in FIGS. 8A and 8B) of the slidable door and a second integral cranked part 113 substantially at right angles to the one part 109 providing an extension which extends away from the part 212 of the door section. As seen in FIG. 8A the extension 213 is received in a groove 214 in a transom 215 of the door 200 so that the device 205 effectively bridges a mitre joint 216 between the part or stile 212 of the door and the transom 215. The extension 213 butts up against the door frame 208 as shown, FIGS. 8A and 8B.

In use, in the open mode or position of the door 200 the extension 113 is remote from the keeper element 104,204. When the door is slidden in the direction of the arrow the closed mode, the extension 113 slides along the underside of the door frame 208 and enters the channel of the keeper element 104 as shown in FIGS. 7A and 8A to provide a positive engagement between the door 200 and door frame 208. Stated in another way, the interengagement of the device 105 and the keeper element 104 maintains positive location of the part 212 of the door 200 with the transom, lintel or top frame section 215 of the door 200. This positive engagement strengthens the otherwise vulnerable area at the interaction between a locating groove along the transom and a mating 'upstand' or depending spigot on the door frame, thereby obviating disruption of the lockable means such as a patio interlock located intermediate the length of the door section below the level of the device 105 at the meter joint or junction 216 (FIGS. 8A, 8B). It will be understood that this junction is vulnerable to being disengaged by the application of force to the top of the door, particularly at its trailing edge, the edge shown in the drawings. Typically the patio interlock includes hooks which are carried on an 'interlock' or leading edge section of a slidable door for engaging in seating means in a door frame, or edge of a second door when there are two patio doors.

When the door is in the closed mode, and unlocked, the door 200 can be slid in the opposite direction to the direction 'X' to the open position, which action disengages the extension 113 from the keeper element 104.

Modifications are possible. Thus FIG. 9 shows apparatus 300 in which there is a device 301 comprising a right angle member for engaging in keeper element 304 of channel section as in FIGS. 7A and 7B. In FIGS. 10A and 10B there is shown a further embodiment 400 in which a keeper element 404 has a blind slot 405 at the end facing the extension 402 of device 401, a right angle member like that 301 of FIG. 9, which extension 402 carries an upstanding pin 403 with a laterally extending or transverse head 406. In use, the upstanding part or shank of the pin 403 is received in the slot 405 with the head 406 extending in sliding engagement between the upstanding limbs of the channel of the keeper element 404 to provide positive interengagement of the keeper element and device in the closed, locked, mode of the door (see FIG. 10B). A yet further embodiment 500 is shown in FIGS. 11A and 11B in which the pin 403 of FIGS. 10A and 10B is replaced by an upstanding hook-like member 501 which in use in the closed, locked, position of the door is received in the slot 502 of keeper element 503 to provide positive interengagement of the keeper element 503 and device 504.

It will be understood too that the keeper element may comprise an element of T-section, suitably being an elongate element, the bar of the 'T' being secured to the frame and the (or each) depending shank thereof being adapted to receive in sliding engagement the extension of the device which extension is of channel section.

It will be understood that in all the embodiments of FIGS. 7A to 11B, including the 'T' section keeper element and channel shaped extension of the device, the positive interengagement of the keeper element and device in the closed, locked, position of the door obviates disruption of the locking means and maintains the integrity of the door. Stated in another way, the interengagement of parts 104 and 105 prevents the top of the door, particularly at the meter 216, from being forced away from the frame 208.

As shown, see FIG. 7A, the free or distal end of the extension is tapered to form a nose 600 which facilitates entry of the extension into the channel section keeper element. Also, in a preferred construction, the width of the extension 113 is such as to provide a snug sliding fit between the upstanding limbs of the channel section, so as to provide positive interengagement without yawing when the extension and channel section are interengaged.

It will further be understood that the expression 'closure member' used herein includes slidable windows as well as doors, particularly but not limited to the larger sliding windows often used in the USA.

The keeper elements and devices 104 and 105, and device are suitably made of metal, possibly coated with plastic for ease of interengagement.

Referring to FIGS. 12-29 of the drawings, in which like parts are referred to by like numerals, there is shown apparatus for securing together two closure members such as slidable doors or windows (particularly suitable for patio access) which are slidable towards and away from each other to provide a respective open and closed mode, comprising a plurality of devices 702 adapted to secure the closure members (which are not shown) in a closed mode. It will be understood that all the embodiments include a control unit (not shown in any of Figsfirst and second to 29)

like the control unit 6 shown and disclosed hereinbefore and in our co-pending application GB 1421124.7, the disclosure of which is incorporated herein, the control member being adapted to operate the securing devices. The control unit for each embodiment of apparatus can comprise a handle, situated generally centrally longitudinally of the length of the apparatus, a motor device such as a solenoid device, an electric or electro-mechanical motor, or spring-loaded interlockable devices.

Figure 1:
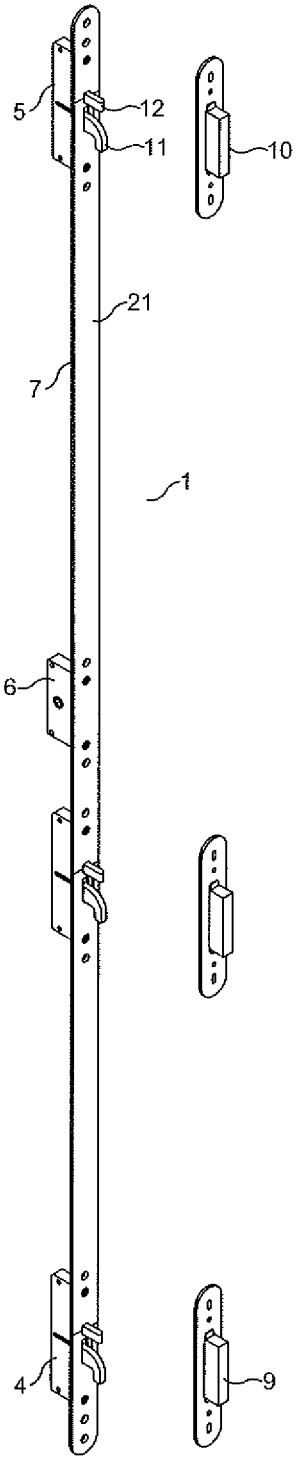
FIG. 1 is a schematic perspective view of apparatus according to the invention.
Figure 2:
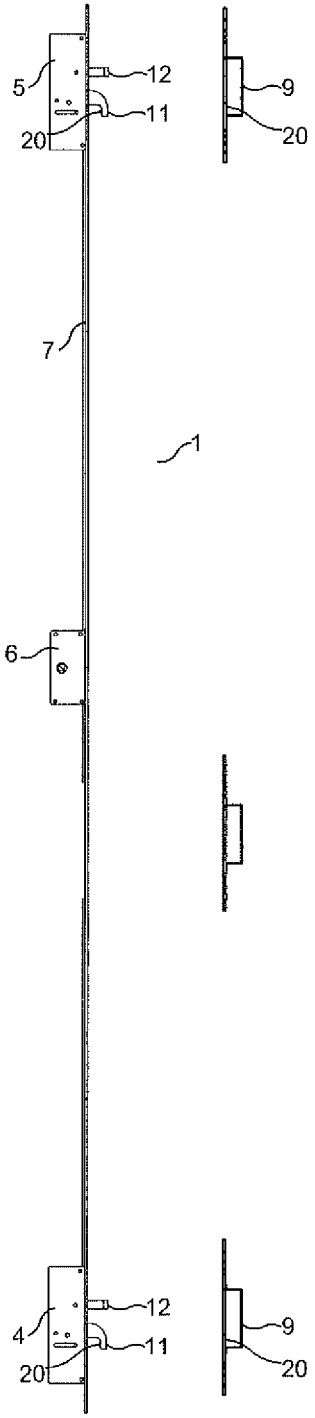
FIG. 2 is a schematic side elevation view of the apparatus of FIG. 1.
Figure 12:
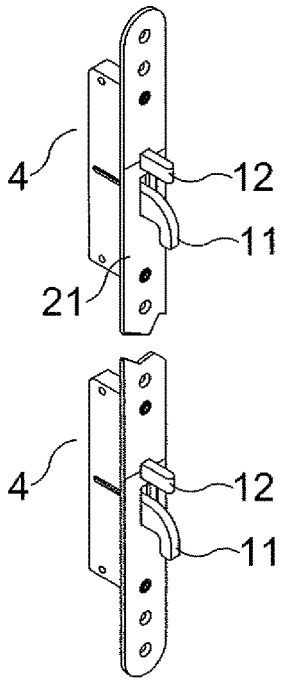

It is to be noted that FIG. 12 essentially corresponds with FIG. 1 of the drawings and referred to hereinabove, and in co-pending application GB1421124.7.

In the embodiments shown, there are two spaced apart securing devices, an upper one and a lower one as viewed, and a single control unit situated intermediately of the two securing devices. The control unit is connected to an elongate member in the form of a flat connecting rod 703. The control device in each case is connected to the connecting rod so that on operation thereof the rod is shifted longitudinally to operate both securing devices in unison.

The securing devices and control unit are mounted with the connecting rod on a face or stile of one of the closure members, such as patio doors. The facing stile of the other door mounts two keeper units (not shown) positioned opposite the shifted position of the securing devices.

Figure 13:
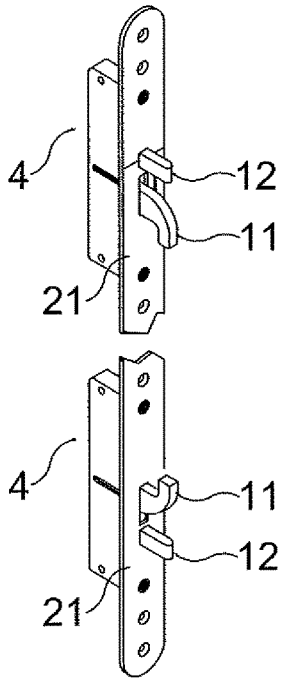
Figure 14:
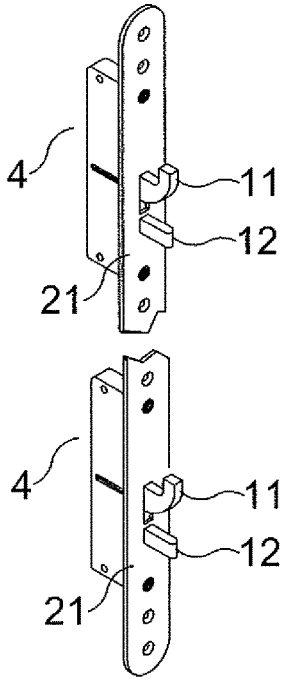

Referring to Figfirst and second, the apparatus comprises two securing devices 4 in the form of latch-like or hook-like members 11 which face downwardly. In FIG. 13 the apparatus comprises two securing devices in the form of hook-like members 11 which are opposed, in other words one member faces upwardly(the upper one as viewed) and the other downwardly (the lower one as viewed). FIG. 14 shows an embodiment in which the securing devices are in the form of hook-like members 11 which both face upwardly.

All three of the aforesaid embodiments include anti-lift devices in the form of reciprocable rods 12 extendible and retractable at substantially right angles to the length of the flat (in the embodiments) connecting rod 21.

Figure 15:
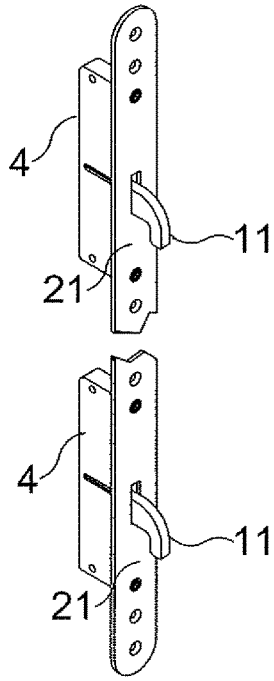
Figure 16:
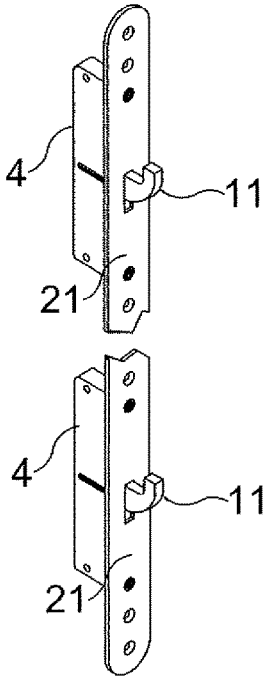
Figure 17:
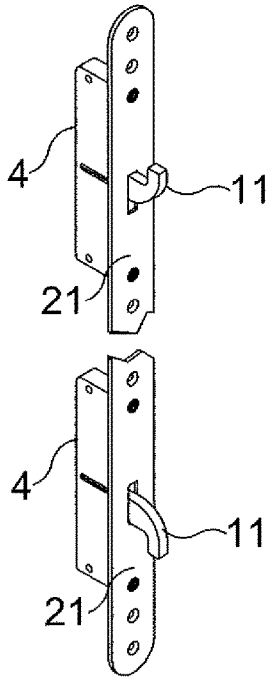

Referring to FIGS. 15, 16 and 17, in the respective apparatuses hook-like members 11 each face downwardly, upwardly, or are opposed, there being no anti-lift device in these embodiments.

Figure 18:
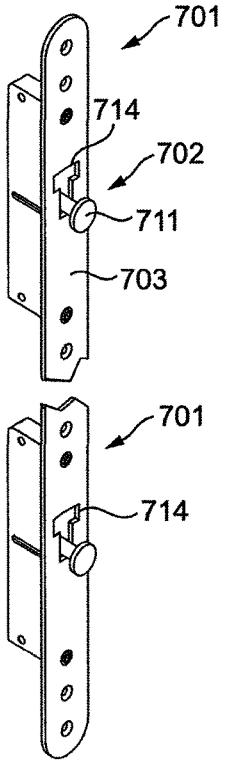
Figure 19:
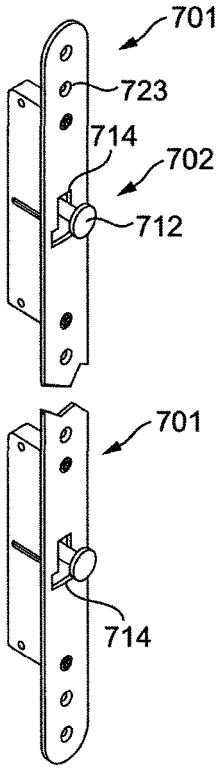
Figure 20:
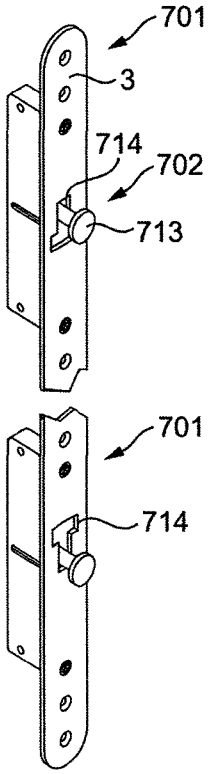

In the embodiments of FIGS. 18, 19 and 20 the respective securing devices comprise pivotable pins 711, 712 , and 713 which protrude through profiled slots 714 through the flat connecting rods, in the embodiments the slots being of T-shape. In FIG. 18 the pins pivot downwardly in use, in FIG. 19 they are pivotable upwardly, and in FIG. 20 they are opposed.

Figure 21:
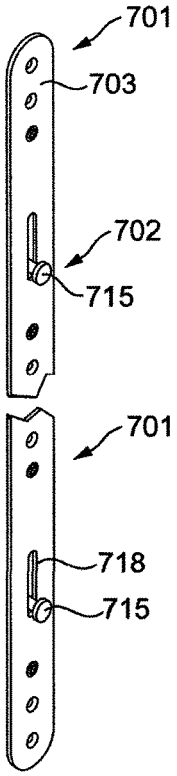
Figure 22:
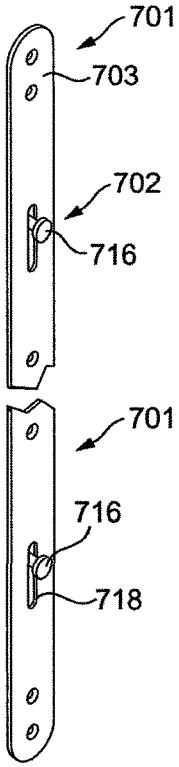
Figure 23:
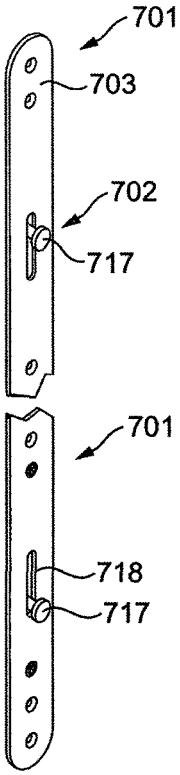

FIGS. 21 to 23 show respective embodiments in which the securing devices comprise fixed pins 715,716 and 717 respectively which extend through elongate blind slots 718 in the connecting rod, in FIG. 21 the pins being up, in FIG. 22 down, and in FIG. 23 being opposed, ie one facing up and one down.

Figure 24:
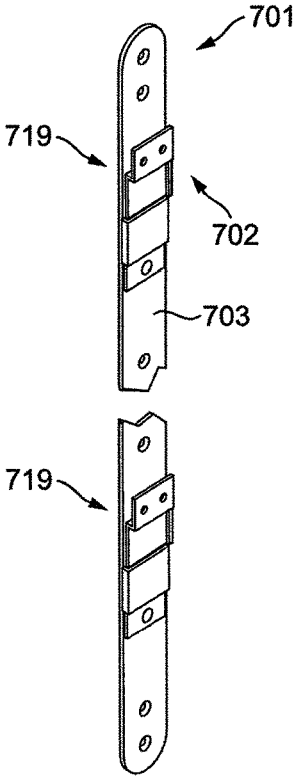
Figure 25:
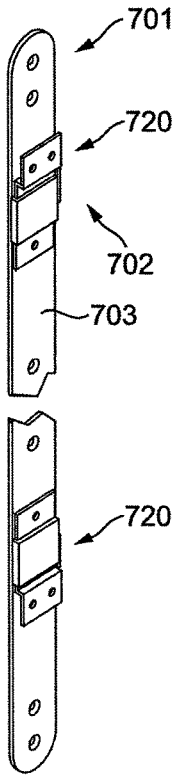

FIGS. 24 to 26 show respective embodiments in which the securing devices 702 each comprise plates or bracket members of L-shape on the connecting rod and which are slidable therewith for engaging and disengaging an opposite keeper on an opposing door. In FIG. 24 the bracket members 719 slide upwardly, in FIG. 25 they are opposing, 20, and in FIG. 26 they slide downwardly, 721.

FIGS. 27, 28 and 29 show three further embodiments respectively in each case being a perspective and side elevational view of a particular embodiment. Common to each embodiment is that the securing devices each comprise a linear pin 722, 723, 724 which has a head 725, 726, 727, the shank of the pin extending through a blind slot in the connecting rod, the pin being adapted to be pulled out away from the connecting rod in the direction of arrows 'x' shown in order to engage a keeper on the opposite closure member. In FIG. 27 the upper and lower pins 722 move upwardly and out, in FIG. 28 they move downwardly and out,723, and in FIG. 29 the pins 724 move in opposed directions, that is the upper pin 724 moves upwardly and the lower pin 724 moves downwardly. The illustration of the three pins shows the three positions of a single pin.

In each embodiment, there is an elongate cover plate having appropriate through orifices aligned with the securing devices secured to the connecting rod.

Using the invention described herein with reference to the drawings, when there is locking means such as a patio interlock means for a patio door, disruption of the locking means in the closed, locked, mode is obviated.

The invention claimed is:

1. An apparatus comprising:

a frame;

a pair of closure members slidable in said frame towards and away from each other so as to define respectively an open mode and a closed mode;

a security device adapted to secure said pair of closure members in the closed mode;

a control unit cooperative with said security device so as to actuate said security device; and a keeper element mountable on a lintel of said frame, said keeper element having a channel section member, said security device releasably engageable with said keeper element in the closed mode so as to engage one of said pair of closure members with said frame such that said channel section member is open upwardly, said security device comprising:

a bracket securable to an upper trailing edge of the closure member; and an extension receivable in said channel section member in the closed mode so as to provide a positive engagement between said frame and an upper edge of the closure member.

2. The apparatus of claim 1, said security device comprising a pair of security devices that are spaced apart, wherein said pair of security devices are mounted on a face or stile of one of said pair of closure members, said control unit located between said pair of security devices.

3. The apparatus of claim 2, each of said pair of security devices comprising a latch member and an anti-lift member.

4. The apparatus of claim 3, further comprising:

a reciprocably slidable connecting member that contacts said pair of securing devices and said control unit so as to actuate said pair of securing devices between the open mode and closed mode.

5. The apparatus of claim 4, wherein said pair of securing devices and said control unit are mounted to one of said pair of closure members, the keeper element being mounted to another of said pair of closure elements facing the respective securing device of said pair of securing devices.

6. The apparatus of claim 5, wherein said latch member is a hook member.

7. The apparatus of claim 6, wherein said hook member is pivotable between a retracted position and an extended position by the connecting member.

8. The apparatus of claim 5, wherein said anti-lift member is movable between a retracted position and an extended position by the connecting member.

9. The apparatus of claim 8, wherein said hook member and said keeper element define complementary sloped surfaces that urge said pair of closure members together in the closed mode.

10. The apparatus of claim 1, further comprising:

a lever cooperative with said control unit so as to operate said control unit.

11. The apparatus of claim 1, further comprising:

a key cooperative with said control unit so as to operate said control unit.

12. The apparatus of claim 6, further comprising:

a cam-and-follower arrangement that moves said hook member and said anti-lift member between a retracted position and an extended position.

13. The apparatus of claim 1, wherein one of said pair of closure members has an extension forming a cranked part of the closure member.

14. The apparatus of claim 1, wherein said channel section member defines a slot, the apparatus further comprising:

an upright member slidably received in the slot so as to lock said pair of closure members in the closed mode.

15. The apparatus of claim 14, wherein said upright member is a pin with a laterally extending head.

16. The apparatus of claim 1, further comprising:

an extension having a tapered leading end insertable into said channel section member so as to facilitate entry into said channel section member.

17. The apparatus of claim 16, wherein said extension and said channel section member have a close sliding lateral fit.

18. The apparatus of claim 16, wherein said extension and said channel section member are formed of a metal material.

* * * * *